United States Patent [19]

Bier et al.

[11] 4,246,875

[45] Jan. 27, 1981

[54] APPARATUS AND SYSTEM FOR CONTROLLING THE AIR-FUEL RATIO SUPPLIED TO A COMBUSTION ENGINE

[75] Inventors: Kenneth, C. Bier, Bloomfield Hills; Robert J. Miller, Warren, both of Mich.

[73] Assignee: Colt Industries Operating Corp, New York, N.Y.

[21] Appl. No.: 924,159

[22] Filed: Jul. 13, 1978

Related U.S. Application Data

[62] Division of Ser. No. 684,547, May 10, 1976, Pat. No. 4,135,482.

[51] Int. Cl.[3] ..... F02M 1/10; F02M 7/20

[52] U.S. Cl. ..... 123/440; 123/438; 261/69 R

[58] Field of Search ..... 123/119 EC, 119 R, 124 E, 123/119 D; 261/121 B, 69 R, 50 R, DIG. 74

[56] References Cited

U.S. PATENT DOCUMENTS

| | | | |
|---|---|---|---|
| 1,575,877 | 3/1926 | Tice | 261/69 R |
| 2,394,663 | 2/1946 | Carlson | 261/69 R |
| 3,706,444 | 12/1972 | Masaki | 261/69 R |
| 3,744,346 | 7/1973 | Miner | 123/119 EC |
| 3,933,951 | 1/1976 | Fischer | 123/119 EC |

*Primary Examiner*—Ronald R Lazarus

*Attorney, Agent, or Firm*—Walter Potoroka, Sr.

[57] ABSTRACT

A carbureting type fuel metering apparatus has an induction passage into which fuel is fed by several fuel metering systems among which are a main fuel metering system and an idle fuel metering system, as generally known in the art; engine exhaust gas analyzing means sensitive to selected constituents of such exhaust gas creates feedback signal means which through associated transducer means become effective for controllably modulating the metering characteristics of the main fuel metering system and the idle fuel metering system.

32 Claims, 9 Drawing Figures

APPARATUS AND SYSTEM FOR CONTROLLING THE AIR-FUEL RATIO SUPPLIED TO A COMBUSTION ENGINE

This is a division, of application Ser. No. 684,547, filed May 10, 1976 now U.S. Pat. No. 4,133,482.

BACKGROUND OF THE INVENTION

Even though the automotive industry has over the years, if for no other reason than seeking competitive advantages, continually exerted efforts to increase the fuel economy of automotive engines, the gains continually realized thereby have been deemed by various levels of governments as being insufficient. Further, such levels of government have also imposed regulations specifying the maximum permissible amounts of carbon monoxide (CO), hydrocrabons (HC) and oxides of nitrogen ($NO_x$) which may be emitted by the engine exhaust gases into the atmosphere.

Unfortunately, the available technology employable in attempting to attain increases in engine fuel economy is generally, contrary to that technology employable in attempting to meet the governmentally imposed standards on exhaust emissions.

For example, the prior art, in trying to meet the standards for $NO_x$ emissions, has employed a system of exhaust gas recirculation whereby at least a portion of the exhaust gas is re-introduced into the cylinder combustion chamber to thereby lower the combustion temperature therein and consequently reduce the formation of $NO_x$.

The prior art has also proposed the use of engine crankcase recirculation means whereby the vapors which might otherwise become vented to the atmosphere are introduced into the engine combustion chambers for burning.

The prior art has also proposed the use of fuel metering means which are effective for metering a relatively overly-rich (in terms of fuel) fuel-air mixture to the engine combustion chamber means as to thereby reduce the creation of $NO_x$ within the combustion chamber. The use of such overly-rich fuel-air mixtures results in a substantial increase in CO and HC in the engine exhaust, which, in turn, requires the supplying of additional oxygen, as by an associated air pump, to such engine exhaust in order to complete the oxidation of the CO and HC prior to its delivery into the atmosphere.

The prior art has also heretofore proposed retarding of the engine ignition timing as a further means for reducing the creation of $NO_x$. Also, lower engine compression ratios have been employed in order to lower the resulting combustion temperature within the engine combustion chamber and thereby reduce the creation of $NO_x$.

The prior art has also proposed the use of fuel metering injection means instead of the usually-employed carbureting apparatus and, under superatmospheric pressure, injecting the fuel into either the engine intake manifold or directly into the cylinders of a piston type internal combustion engine. Such fuel injection systems, besides being costly, have not proven to be generally successful in that the system is required to provide metered fuel flow over a very wide range of metered fuel flows. Generally, those injection systems which are very accurate at one end of the required range of metered fuel flows, are relatively inaccurate at the opposite end of that same range of metered fuel flows. Also, those injection systems which are made to be accurate in the mid-portion of the required range of metered fuel flows are usually relatively inaccurate at both ends of that same range. The use of feedback means for altering the metering characteristics of a particular fuel injection system have not solved the problem because the problem usually is intertwined with such factors as: effective aperture area of the injector nozzle; comparative movement required by the associated nozzle pintle or valving member; inertia of the nozzle valving member; and nozzle "cracking" pressure (that being the pressure at which the nozzle opens). As should be apparent, the smaller the rate of metered fuel flow desired, the greater becomes the influence of such factors thereon.

It is now anticipated that the said various levels of government will be establishing even more stringent exhaust emission limits of, for example, 1.0 gram/mile of $NO_x$ (or even less).

The prior art, in view of such anticipated requirements with respect to $NO_x$, has suggested the employment of a "three-way" catalyst, in a single bed, within the stream of exhaust gases as a means of attaining such anticipated exhaust emission limits. Generally, a "three-way" catalyst (as opposed to the "two way" catalyst system well known in the prior art) is a single catalyst, or catalyst mixture, which catalyzes the oxidation of hydrocarbons and carbon monoxide and also the reduction of oxides of nitrogen. It has been discovered that a difficulty with such a "three-way" catalyst system is that if the fuel metering is too rich (in terms of fuel), the $NO_x$ will be reduced effectively, but the oxidation of CO will be incomplete. On the other hand, if the fuel metering is too lean, the CO will be effectively oxidized but the reduction of $NO_x$ will be incomplete. Obviously, in order to make such a "three-way" catalyst system operative, it is necessary to have very accurate control over the fuel metering function of associated fuel metering supply means feeding the engine. As hereinafter described, the prior art has suggested the use of fuel injection means with associated feedback means (responsive to selected indicia of engine operating conditions and parameters) intended to continuously alter or modify the metering characteristics of the fuel injection means. However, at least to the extent hereinafter indicated, such fuel injection systems have not proven to be successful.

It has also heretofore been proposed to employ fuel metering means, of a carbureting type, with feedback means responsive to the presence of seleted constituents comprising the engine exhaust gases. Such feedback means were employed to modify the action of a main metering rod of a main fuel metering system of a carburetor. However, tests and experience have indicated that such a prior art carburetor and such a related feedback means cannot, at least as presently conceived, provide the degree of accuracy required in the metering of fuel to an associated engine as to assure meeting, for example, the said anticipated exhaust emission standards.

Accordingly, the invention as disclosed, described and claimed is directed generally to the solution of the above and related problems and more specifically to structure, apparatus and systems enabling a carbureting type fuel metering device to meter fuel with an accuracy at least sufficient to meet the said anticipated standards regarding engine exhaust gas emissions.

SUMMARY OF THE INVENTION

According to the invention, a carburetor having an induction passage therethrough with a venturi therein has a main fuel discharge nozzle situated generally within the venturi and a main fuel metering system communicating generally between a fuel reservoir and the main fuel discharge nozzle. An idle fuel metering system communicates generally between a fuel reservoir and said induction passage at a location generally in close proximity to an edge of a variably openable throttle valve situated in said induction passage downstream of the main fuel discharge nozzle. Modulating valving means are provided to controllably alter the rate of metered fuel flow through each of said main and idle fuel metering systems in response to control signals generated as a consequence of selected indicia of engine operation.

Various general and specific objects and advantages of the invention will become apparent when reference is made to the following detailed description of the invention considered in conjunction with the related drawings.

BRIEF DESCRIPTION OF THE DRAWINGS

In the drawings wherein for purposes of clarity certain details and/or elements may be omitted from one or more views.

DETAILED DESCRIPTION OF THE PREFERRED EMBODIMENT

Figure 1:
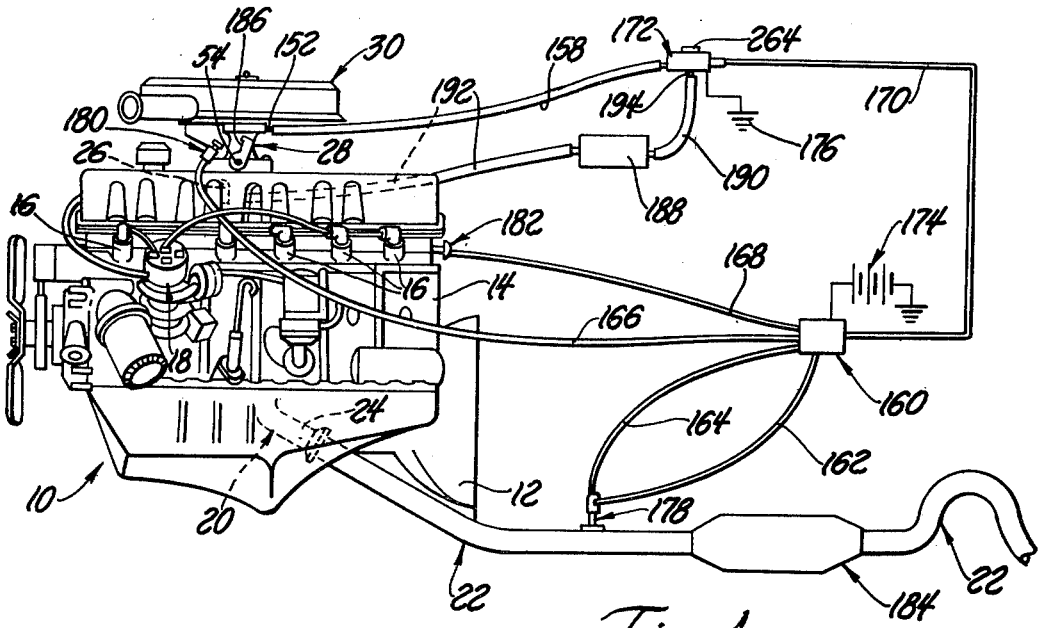
FIG. 1 illustrates, in side elevational view, a vehicular combustion engine employing a carbureting apparatus and system embodying teachings of the invention.

Referring now in greater detail to the drawings, FIG. 1 illustrates a combustion engine 10 used, for example, to propell an associated vehicle as through power transmission means fragmentarily illustrated at 12. The engine 10 may be of the internal combustion type employing, as is generally well known in the art, a plurality of power piston means therein. As generally depicted, the engine assembly 10 is shown as being comprised of an engine block 14 containing, among other things, a plurality of cylinders respectively reciprocatingly receiving said power pistons therein. A plurality of spark or ignition plugs 16, one for each cylinder, are carried by the engine block and respectively electrically connected to an ignition distributor assembly or system 18 operated in timed relationship to engine operation.

As is generally well known in the art, each cylinder containing a power piston has exhaust aperture or port means and such exhaust port means communicate as with an associated exhaust manifold which is fragmentarily illustrated in hidden line at 20. Exhaust conduit means 22 is shown operatively connected to the discharge end 24 of exhaust manifold 20 and leading as to the rear of the associated vehicle for the discharging of exhaust gases to the atmosphere.

Further, as is also generally well known in the art, each cylinder which contains a power piston also has inlet aperture means or port means and such inlet aperture means communicate as with an associated inlet manifold which is fragmentarily illustrated in hidden line at 26.

As generally depicted, a carbureting type fuel metering apparatus 28 is situated atop a cooperating portion of the inlet or intake manifold means 26. A suitable inlet air cleaner assembly 30 may be situated atop the carburetor assembly 28 to filter the air prior to its entrance into the inlet of the carburetor 28.

Figure 2:
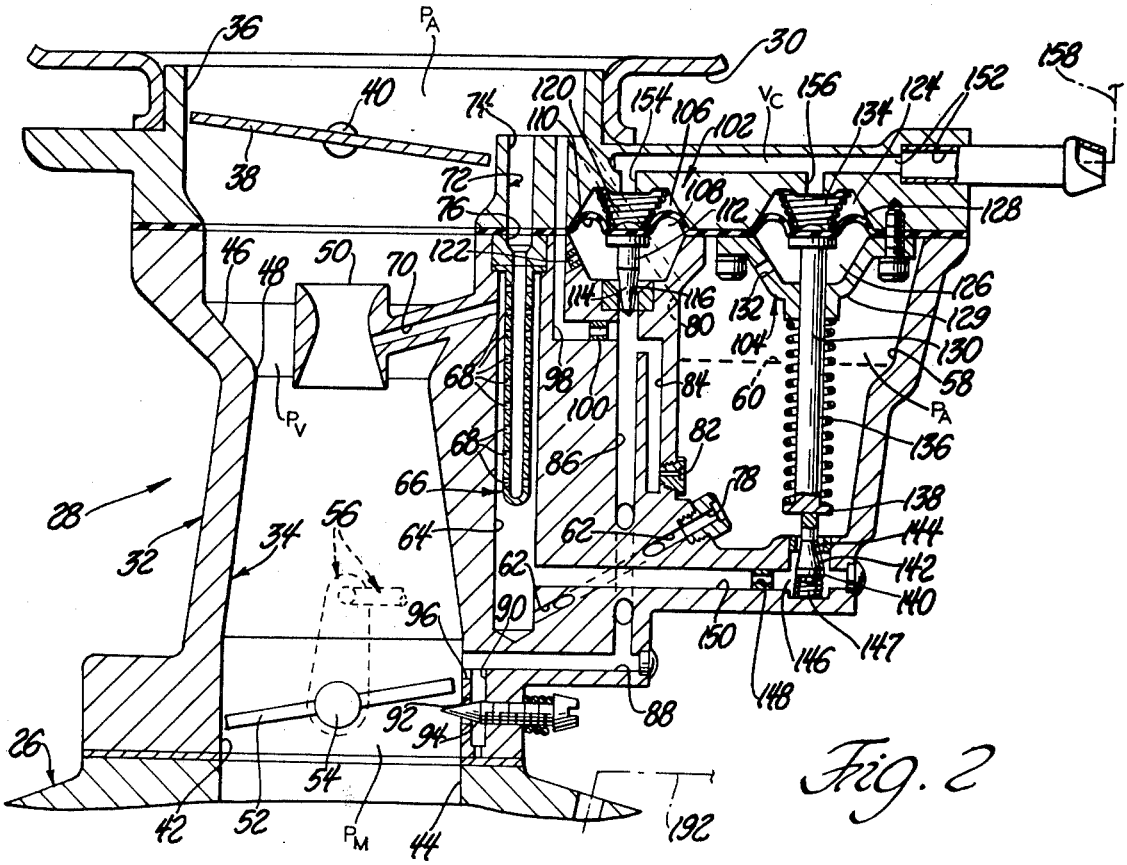
FIG. 2 is an enlarged view of a carburetor assembly, in cross-section, constructed in accordance with the invention.

As generally shown in FIG. 2, the carburetor 28, employing teachings of the invention, comprises a main carburetor body 32 having induction passage means 34 formed therethrough with an upper inlet end 36, in which generally is situated a variably openable choke valve 38 carried as by a pivotal choke shaft 40, and a discharge end 42 communicating as with the inlet 44 of intake manifold 26. A venturi section 46, having a venturi throat 48, is provided within the induction passage means 34 generally between the inlet 36 and outlet or discharge end 42. A main metering fuel discharge nozzle 50, situated generally within the throat 48 of venturi section 46, serves to discharge fuel, as is metered by the main metering system, into the induction passage means 34.

A variably openable throttle valve 52, carried as by a rotatable throttle shaft 54, serves to variably control the discharge and flow of combustible (fuel-air) mixtures into the inlet 44 of intake manifold 26. Suitable throttle control linkage means, as generally depicted at 56, is provided and operatively connected to throttle shaft 54 in order to affect throttle positioning in response to vehicle operator demand. The throttle valve, as will become more evident, also serves to vary the rate of fuel flow metered by the associated idle fuel metering system and discharged into the induction passage means.

Carburetor body means 32 may be formed as to also define a fuel reservoir chamber 58 adapted to contain fuel 60 therein the level of which may be determined as by, for example, a float operated fuel inlet valve assembly, as is generally well known in the art.

The main fuel metering system comprises passage or conduit means 62 communicating generally between fuel chamber 58 and a generally upwardly extending main fuel well 64 which, as shown, may contain a main well tube 66 which, in turn, is provided with a plurality of generally radially directed apertures 68 formed through the wall thereof as to thereby provide for communication as between the interior of the tube 66 and the portion of the well 64 generally radially surrounding the tube 66. Conduit means 70 serves to communicate between the upper part of well 64 and the interior of discharge nozzle 50. Air bleed type passage means 72, comprising conduit means 74 and calibrated restriction or metering means 76, communicates as between a source of filtered air and the upper part of the interior of well tube 66. A main calibrated fuel metering restriction 78 is situated generally upstream of well 64, as for example in conduit means 62, in order to meter the rate of fuel flow from chamber 58 to main well 64. As is generally well known in the art, the interior of fuel reservoir chamber 58 is preferably pressure vented to a source of generally ambient air as by means of, for example, vent-like passage means 80 leading from chamber 58 to the inlet end 36 of induction passage 34.

Generally, when the engine is running, the intake stroke of each power piston causes air flow through the induction passage 34 and venturi throat 48. The air thusly flowing through the venturi throat 48 creates a low pressure commonly referred to as a venturi vacuum. The magnitude of such venturi vacuum is determined primarily by the velocity of the air flowing through the venturi and, of course, such velocity is determined by the speed and power output of the engine. The difference between the pressure in the venturi and the air pressure within fuel reservoir chamber 58 causes fuel to flow from fuel chamber 58 through the main metering system. That is, the fuel flows through metering restriction 78, conduit means 62, up through well 64 and, after mixing with the air supplied by the main well air bleed means 72, passes through conduit means 70 and discharges from nozzle 50 into induction passage means 34. Generally, the calibration of the various controlling elements are such as to cause such main metered fuel flow to start to occur at some predetermined differential between fuel reservoir and venturi pressure. Such a differential may exist, for example, at a vehicular speed of 30 m.p.h. at normal road load.

Engine and vehicle operation at conditions less than that required to initiate operation of the main metering system are achieved by operation of the idle fuel metering system, which may not only supply metered fuel flow during curb idle engine operation but also at off idle operation.

At curb idle and other relatively low speeds of engine operation, the engine does not cause a sufficient air flow through the venturi section 48 as to result in a venturi vacuum sufficient to operate the main metering system. Because of the relatively almost closed throttle valve means 52, which greatly restricts air flow into the intake manifold 26 at idle and low engine speeds, engine or intake manifold vacuum is of a relatively high magnitude. This high manifold vacuum serves to provide a pressure differential which operates the idle fuel metering system.

Generally, the idle fuel system is illustrated as comprising calibrated idle fuel restriction metering means 82 communicating as between the fuel 60, within fuel reservoir or chamber 58, and a generally upwardly extending passage or conduit 84 which, at its upper end, is in communication with a second generally vertically extending conduit 86 the lower end of which communicates with a generally laterally extending conduit 88. A downwardly depending conduit 90 communicates at its upper end with conduit 88 while, at its lower end, it communicates with induction passage means 34 as through aperture means 92. The effective size of discharge aperture 92 is variably established as by an axially adjustable needle valve member 94 threadably carried by body 32. As generally shown and as generally known in the art, passage 88 may terminate in a relatively vertically elongated discharge opening or aperture 96 located as to be generally juxtaposed to an edge of throttle valve 52 when such throttle valve 52 is in its curb-idle or nominally closed position. Often, aperture 96 is referred to in the art as being a transfer slot effectively increasing the area for flow of fuel to the underside of throttle valve 52 as the throttle valve is moved toward a more fully opened position.

Conduit means 98, provided with calibrated air metering or restriction means 100, serves to communicate as between an upper portion of conduit 86 and a source of atmospheric air as at the inlet and 36 of induction passage 34. At idle engine operation, the greatly reduced pressure area below the throttle valve means causes fuel to flow from the fuel reservoir 58 through restriction means 82 and upwardly through conduit means 84 where, generally at the upper portion thereof, the fuel intermixes with the bleed air provided by conduit 98 and air bleed restriction means 100. The fuel-air emulsion then is drawn downwardly through conduit 86 and through conduits 88 and 90 ultimately discharged, posterior to throttle valve 52, through the effective opening of aperture 92.

During off-idle operation, the throttle valve means 52 is moved in the opening direction cuasing the juxtaposed edge of the throttle valve to further effectively open and expose a greater portion of the transfer slot or port means 96 to the manifold vacuum existing posterior to the throttle valve. This, of course, causes additional metered idle fuel flow through the transfer port means 96. As the throttle valve means 52 is opened still wider and the engine speed increases, the velocity of air flow through the induction passage 34 increases to the point where the resulting developed venturi vacuum is sufficient to cause the hereinbefore described main metering system to be brought into operation.

The invention as herein disclosed and described provides means, in addition to those hereinbefore described, for controlling and/or modifying the metering characteristics otherwise established by the fluid circuit constants previously described. In the embodiment disclosed, among other cooperating elements, valving assemblies 102 and 104 are provided to enable the performance of such modifying and/or control functions.

Valving assembly 102 is illustrated as comprising variable but distinct chambers 106 and 108 effectively separated as by a pressure responsive wall or diaphragm member 110 which, in turn, has a valving member 112 operatively secured thereto for movement therewith. The valving surface 114 of valving member 112 cooperates with a calibrated aperture 116 of a member 118 as to thereby variably determine the effective cross-sectional flow area of said aperture 116 and therefore the degree to which communication between the upper portion of conduit 86 and chamber 108. Resiliant means, as in the form of a compression spring 120 situated generally in chamber 106, serves to continually bias and urge diaphragm member 110 and valving member 112 toward a fully closed position against coacting aperture 116. As shown, chamber 108 is placed in communication with ambient atmosphere preferably through associated calibrated restriction or passage means 122 and via conduit means 98. Without at this time considering the overall operation, it should be apparent that for any selected differential between the manifold vacuum, $P_m$, and the pressure, $P_a$, within reservoir 58, the "richness" of the fuel delivered by the idle fuel metering system can be modulated merely by the moving of valving member 112 toward and/or away from coacting aperture means 116. That is, for any such given pressure differential, the greater the effective opening of aperture means 116 becomes the more air is bled into the idle fuel passing from conduit 84 into conduit 86. Therefore, because of such proportionally greater rate of flow of idle bleed air, the less, proportionately, is the rate of metered idle fuel flow thereby causing athe richness (in terms of fuel) in the fuel-air mixture supplied through the induction passage 34 and into the intake manifold 26. The converse is also true; that is, as aperture means 116 is more nearly totally closed, the total rate of flow of idle bleed air becomes increasingly more dependent upon the comparatively reduced effective flow area of restriction means 100 thereby proportionately reducing the rate of idle bleed air and increasing, proportionately, the rate of metered idle fuel flow. Accordingly, there is an accompanying increase in the richness (in terms of fuel) in the fuel-air mixture supplied through induction passage 34 and into the intake manifold 26.

Valving assembly 104 is illustrated as comprising upper and lower variable and distinct chambers 124 and 126 separated as by a pressure responsive wall or diaphragm member 128 to which is secured one end of a valve stem 130 as to thereby move in response to and in accordance with the movement of wall or diaphragm means 128. The structure 129 defining the lower portion of chamber 126 serves to provide guide surface means for guiding the vertical movement of valve stem 130 and the chamber 126 is vented to atmospheric pressure, $P_a$, as by vent or aperture means 132.

A first compression spring 134 situated generally within chamber 124 continually urges valve stem 130 in a downward direction as does a second spring 136 which is carried generally about stem 130 and axially contained as between structure 129 and a movable spring abutment 138 carried by stem 130.

An extension of stem 130 carries a valve member 140 with a valve surface 142, formed thereon, adapted to cooperate with a valving orifice 144 communicating generally between chamber 58 and a chamber-like area 146 which, in turn, communicates as via calibrated metering or restriction means 148 and conduit means 150 with a portion of the main metering system downstream of the main metering restriction means 78. As illustrated, such communication may be at a suitable point within the main well 64. Additional spring means 147 which may be situated generally in the chamber-like area 146, serve to continually urge valve member 142 and stem 130 upwardly.

Without at this time considering the overall operation of the invention, it should be apparent that for any selected metering pressure differential between the venturi vacuum, $P_v$, and the pressure, $P_a$, within reservoir 58, the "richness" of the fuel delivered by the main fuel metering system can be modulated merely by the moving of valving member 140 toward and/or away from coacting aperture means 144. That is, for any such given metering pressure differential, the greater the effective opening of aperture means 144 becomes, the greater also becomes the rate of metered fuel flow since one of the factors controlling such rate is the effective area of the metering orifice means. With the opening of orifice means 144 it can be seen that the then effective metering area of orifice means 144 is, generally, additive to the effective metering area of orifice means 78. Therefore, a comparatively increased rate of metered fuel flow is consequently discharged, through nozzle 50, into the induction passage means 34. The converse is also true; that is, as aperture means 144 is more nearly or totally closed, the total effective main fuel metering area decreases and approaches that effective metering area determined by metering means 78. Consequently, the total rate of metered main fuel flow decreases and a comparatively decreased rate of metered fuel flow is discharged through nozzle 50, into the induction passage 34.

As shown, chamber 106 and 124 are each in communication with conduit means 152, as via conduit means 154 and 156, respectively.

As illustrated in FIG. 1, conduit means 152 is placed in communication with associated conduit means 158 effective for conveying a fluid control pressure to said conduit 152 and chambers 106 and 124. For purposes of illustration, such control pressure will be considered as being sub-atmospheric and to that extent a control vacuum, $V_c$, the magnitude of which, of course, increases as the absolute value of the control pressure decreases.

FIG. 1 also illustrates suitable logic control means 160 which, as contemplated in the preferred mode of operation of the invention, may be electrical logic control means having suitable electrical signal conveying conductor means 162, 164, 166 and 168 leading thereto for applying electrical input signals, reflective of selected operating parameters, to the circuitry of logic means 160. It should, of course, be apparent that such input signals may convey the required information in terms of the magnitude of the signal as well as conveying information by the absence of the signal itself. Output electrical conductor means, as at 170, serves to convey the output electrical control signal from the logic means 160 to associated electrically-operated control valve means 172. A suitable source of electrical potential 174 is shown as being electrically connected to logic means 160, while control valve means 172 may be electrically grounded, as at 176.

In the preferred embodiment, the various electrical conductor means 162, 164, 166 and 168 are respectively connected to parameter sensing and transducer signal producing means 178, 180 and 182. In the embodiment of the invention shown, the means 178 comprises oxygen sensor means communicating with exhaust conduit means 22 at a point generally upstream of a catalytic converter 184. The transducer means 180 may comprise electrical switch means situated as to be actuated by cooperating lever means 186 fixedly carried, as by the throttle shaft 55, and swingably rotatable therewith into and out of operating engagement with switch means 180, in order to thereby provide a signal indicative of the throttle 52 having attained a preselected position.

The transducer 182 may comprise suitable temperature responsive means, such as, for example, thermocouple means, effective for engine temperature and creating an electrical signal in accordance therewith.

A vacuum reservoir or tank 188 is shown being operatively connected and in communication with control valve 172, as by conduit means 190, and with the interior of the intake manifold 26 (serving as a source of engine or manifold vacuum, $P_m$) as by conduit means 192.

Even though the invention is not so limited, it is nevertheless contemplated that the catalytic converter means 184 would preferably be of the "three-way" type of catalytic converter as hereinbefore described and as is generally well known in the art. Further, any of many presently available and suitable oxygen sensor assemblies may be employed. Also, although the invention is not so limited, control valve means 172 may comprise a 3-way solenoid valving assembly effective for opening and closing (or otherwise modulating) aperture means for causing a varying effective restrictive effect upon fluid flow through such aperture means and thereby vary the effective pressure magnitudes on opposite sides of such aperture means. By varying the electrical signal to such 3-way solenoid valving assembly, it then becomes possible to selectively vary the magnitude of at least one of the fluid pressures and employ such as a control pressure. Various forms of such control valve assemblies are well known in the art, and, since the specific construction thereof forms no part of the invention, any such suitable control valve assembly may be employed. Further, testing and experimentation with the use of a pulsating type control valve means 172 has shown remarkable and unexpected improvements. As is generally well known in the art, a pulsating type of control valve is one which, during operation, has its valving member in a constant state of oscillation toward and away from the cooperating metering orifice. The manner in which control over resulting fluid flow and/or pressure is may be, generally, by varying the frequency and/or amplitude of such oscillation and/or the relative length of time that such pulsating control valve is energised compared to the length of time that such control valve is de-energized during the over all operating cycle.

OPERATION OF INVENTION

Generally, the oxygen sensor 178 senses the oxygen content of the exhaust gases and, in response thereto, produces an output voltage signal which is proportional or otherwise related thereto. The voltage signal is then applied, as via conductor means 162, to the electronic logic and control means 160 which, in turn, compares the sensor voltage signal to a bias or reference voltage which is indicative of the desired oxygen concentration. The resulting difference between the sensor voltage signal and the bias voltage is indicative of the actual error and an electrical error signal, reflective thereof, is employed to produce a related operating voltage which is applied to the control valve assembly 172 as by means of conductor 170.

Manifold or engine vacuum, generated during engine operation, is conveyed to the vacuum reservoir means 188, which, via conduit means 190, conveys such vacuum to a conduit portion 194 of control valve assembly 172. The operation of control valve assembly 172 is such as to effectively variably bleed or vent a portion of the vacuum as to ambient atmosphere and thereby determine a resulting magnitude of a control vacuum which is applied to conduit means 158. The magnitude of such control vacuum, $V_c$, is, as previously generally described, determined by the electrical control signal and consequent operating voltage applied via conductor means 170 to control valve assembly 172, which, in the embodiment of the invention shown, comprises a solenoid-operated valve assembly.

As best seen in FIG. 2, the control vacuum, $V_c$, is applied via conduit means 152 to both pressure responsive motor means 102 and 104, and more specifically to respective chambers 106 and 124 thereof. Generally, as should be apparent, the greater the magnitude of $V_c$ (and therefore the lower its absolute pressure) the more upwardly are wall or diaphragm members 110 and 128 urged. The degree to which such members 110 and 128 are actually moved upwardly depends, of course, on the resilient resistance thereto provided by spring means 120, 134 and 136, as well as the upward resilient force of spring means 147 situated generally in chamber 146 and operatively engaging valve member 142.

Figure 3:
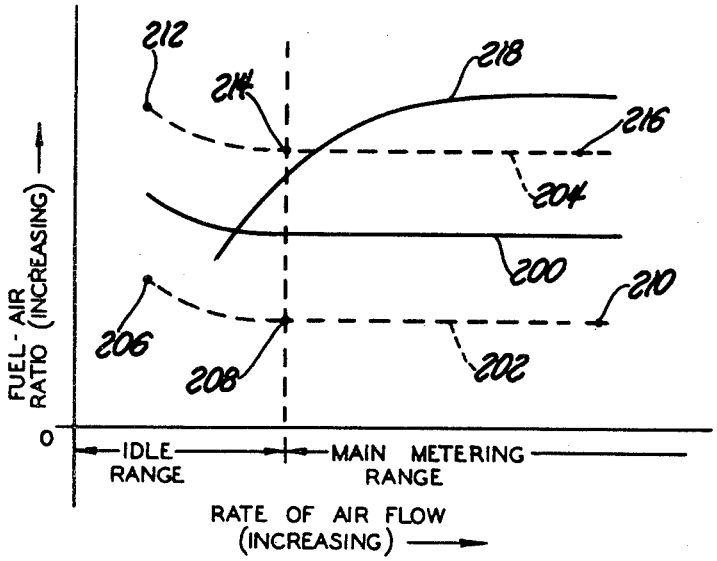
FIG. 3 is a graph illustrating, generally, fuel-air ratio curves obtainable with structures employing the invention.

The graph of FIG. 3 generally depicts fuel-air ratio curves obtainable by the invention. For purposes of illustration, let it be assumed that curve 200 represents a combustible mixture, metered as to have a ratio of 0.068 lbs. of fuel per pound of air. Then, as generally shown, the carbureting device of the invention could provide a flow of combustible mixtures in the range anywhere from a selected lower-most fuel-air ratio as depicted by curve 202 to an uppermost fuel-air ratio as depicted by curve 204. As should be apparent, the invention provides an infinite family of such fuel-air ratio curves between and including curves 202 and 204. This becomes especially evident when one considers that the portion of curve 202 generally between points 206 and 208 is achieved when valve member 112 of FIG. 2 is moved upwardly as to thereby open orifice 116 to its maximum intended effective opening and cause the introduction of a maximum amount of bleed air therethrough. Similarly, that portion of curve 202 generally between points 208 and 210 is achieved when valve member 142 is moved upwardly as to thereby close orifice 144 to its intended minimum effective opening (or totally effectively closed) and cause the flow of fuel therethrough to be terminated or reduced accordingly.

In comparison, that portion of curve 204 generally between points 212 and 214 is achieved when valve member 112 is moved downwardly as to thereby close orifice 116 to its intended minimum effective opening (or totally effectively closed) and cause the flow of bleed air therethrough to be terminated or reduced accordingly. Similarly, that portion of curve 204 generally between points 214 and 216 is achieved when valve member 142 is moved downwardly as to thereby open orifice 144 to its maximum intended opening and cause a corresponding maximum flow of fuel therethrough.

It should be apparent that the degree to which orifices 116 and 114 are respectively opened, during actual operation, depends on the magnitude of the control vacuum, $V_c$, which, in turn, depends on the control signal produced by the logic control means 160 and, of course, the control signal thusly produced by means 160 depends, basically, on the input signal obtained from the oxygen sensor 178, as compared to the previously referred-to bias or reference signal. Accordingly, knowing what the desired composition of the exhaust gas from the engine should be, it then becomes possible to program the logic of means 160 as to create signals indicating deviations from such desired composition as to in accordance therewith modify the effective opening of orifices 116 and 144 to increase and/or decrease the richness (in terms of fuel) of the fuel-air mixture being metered to the engine. Such changes or modifications in fuel richness, of course, are, in turn, sensed by the oxygen sensor 160 which continues to further modify the fuel-air ratio of such metered mixture until the desired exhaust composition is attained. Accordingly, it is apparent that the system disclosed defines a closed-loop feedback system which continually operates to modify the fuel-air ratio of a metered combustible mixture assuring such mixture to be of a desired fuel-air ratio for the then existing operating parameters.

It is also contemplated, at least in certain circumstances, that the upper-most curve 204 may actually be, for the most part, effectively below a curve 218 which, in this instance, is employed to represent a hypothetical curve depicting the best fuel-air ratio of a combustible mixture for obtaining maximum power from engine 10, as during wide open throttle (WOT) operation. In such a contemplated contingency, the invention provides transducer means 180 (FIG. 1) adapted to be operatively engaged, as by lever means 186, when throttle valve 52 has been moved to WOT condition. At that time, the resulting signal from transducer means 180, as applied to means 160, causes logic means 160 to appropiately respond by further altering the effective opening or orifices 116 and 144. That is, it it is assumed that curve portion 214-216 is obtained when effectively opened to a degree less than its actual maximum physical opening, then further effective opening thereof may be accomplished by causing a further downward movement of valve member 140. During such phase of operation, the metering becomes an open loop function and the input signal to logic means 160 provided by oxygen sensor 178 is, in effect, ignored for so long as the WOT signal from transducer 180 exists.

Similarly, in certain engines, because of any of a number of factors, it may be desirable to assure a lean (in terms of fuel richness) base fuel-air ratio (enriched by the well known choke mechanism) immediately upon starting of a cold engine. Accordingly, the invention contemplates the use of engine temperature transducer means 182 which is effective for producing a signal, over a predetermined range of low engine temperatures, and applying such signal to logic control means 160 as to thereby cause such logic means 160 to, in turn, produce and apply a control signal, via 170, to control valve 172, the magnitude of which is such as to cause the resulting fuel-air ratio of the metered combustible mixture to be, for example, in accordance with curve 202 of FIG. 3 or some other selected relatively "lean" fuel-air ratio.

Further, it is contemplated that at certain operating conditions and with certain oxygen sensors, it may be desirable or even necessary to measure the temperature of the oxygen sensor itself. Accordingly, suitable temperature transducer means, as for example thermocouple means well known in the art, may be employed to sense the temperature of the operating portion of the oxygen sensor means 178 and to provide a signal in accordance or in response thereto via conductor means 164 to the electronic control means 160. That is, it is anticipated that it may be necessary to measure the temperature of the sensory portion of the oxygen sensor 178 to determine that such sensor 178 is sufficiently hot to provide a meaningful signal with respect to the composition of the exhaust gas. For example, upon re-stating a generally hot engine, the engine temperature and engine coolant temperatures could be normal (as sensed by transducer means 182) and yet the oxygen sensor 184 is still too cold and therefore not capable of providing a meaningful signal, of the exhaust gas composition, for several seconds after such re-start. Because a cold catalyst cannot clean up from a rick mixture, it is advantageous, during the time that sensor means 184 is thusly too cold, to provide a relatively "lean" fuel-air ratio mixture. The sensor means 184 temperature signal thusly provided along conductor means 164 serves to cause such logic means 160 to, in turn, produce and apply a control signal, via 170 to control valve 172, the magnitude of which is such as to cause the resulting fuel-air ratio of the metered combustible mixture to be, for example, in accordance with curve 202 of FIG. 3 or some other selected relatively "lean" fuel-air ratio.

Figure 4:
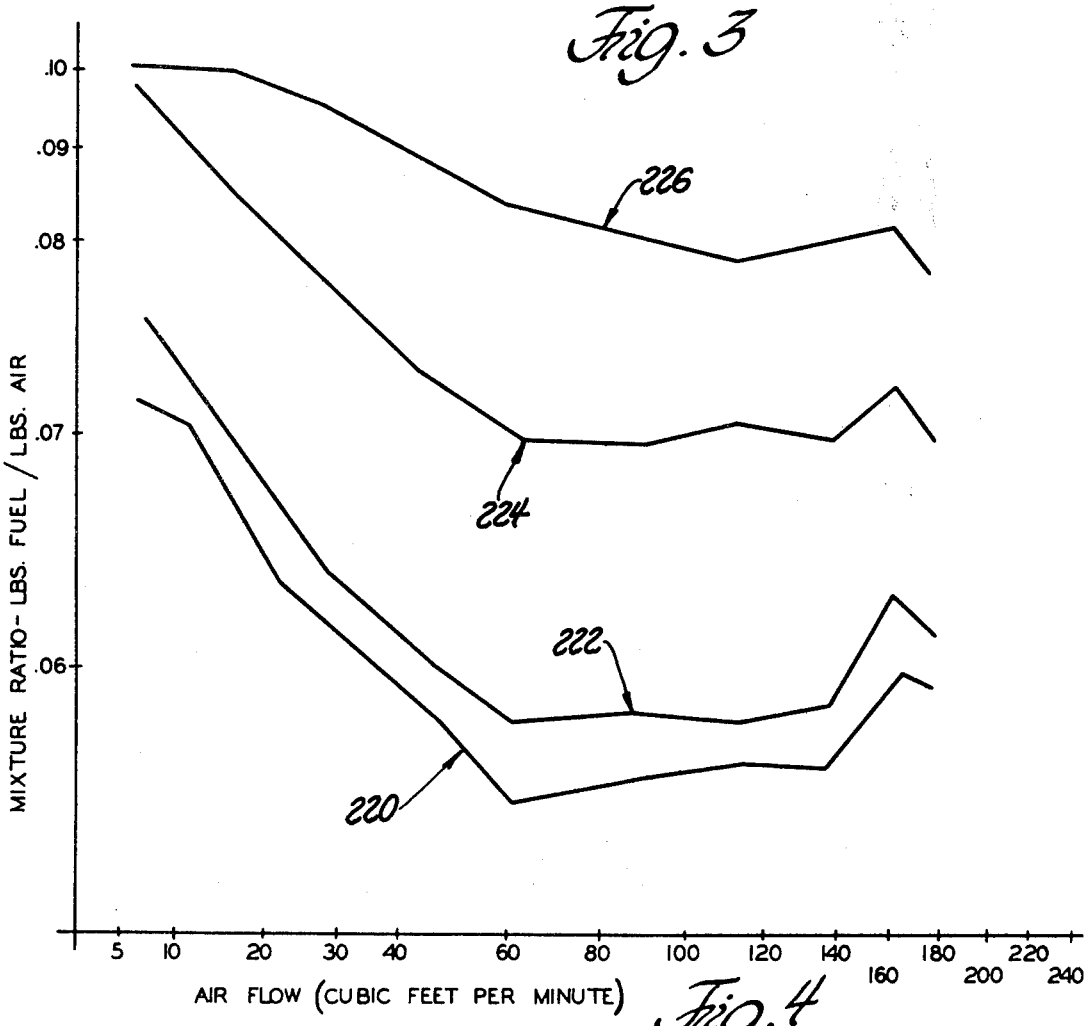
FIG. 4 is a graph depicting fuel-air ratio curves obtained from one particular tested embodiment of the invention.

FIG. 4 illustrates fuel-air mixture curves, obtained during testing of one particular embodiment of the invention with such curves being obtained at various values of control vacuum to the carburetor. That is, flow curve 220 was obtained at a control vacuum of 5.0 inches of $H_g$; flow curve 222 was obtained at 4.0 inches of $H_g$; flow curve 224 was obtained at 2.5 inches of $H_g$ while flow curve 226 was obtained at 1.0 inch of $H_g$. It should be noted that at the maximum applied vacuum (5.0 inches of $H_g$) flow curve 220 corresponds generally to a typical part throttle fuel delivery curve while the flow curve 226 at minimum vacuum (1.0 inch of $H_g$) corresponds generally to a typical best engine power or wide open throttle delivery curve. Accordingly, it can be seen that in the event of a total electronic or vacuum failure in the system disclosed, the associated vehicle remains drivable regardless of whether such failure results in maximum or minimum applied vacuum or anywhere in between.

Figure 5:
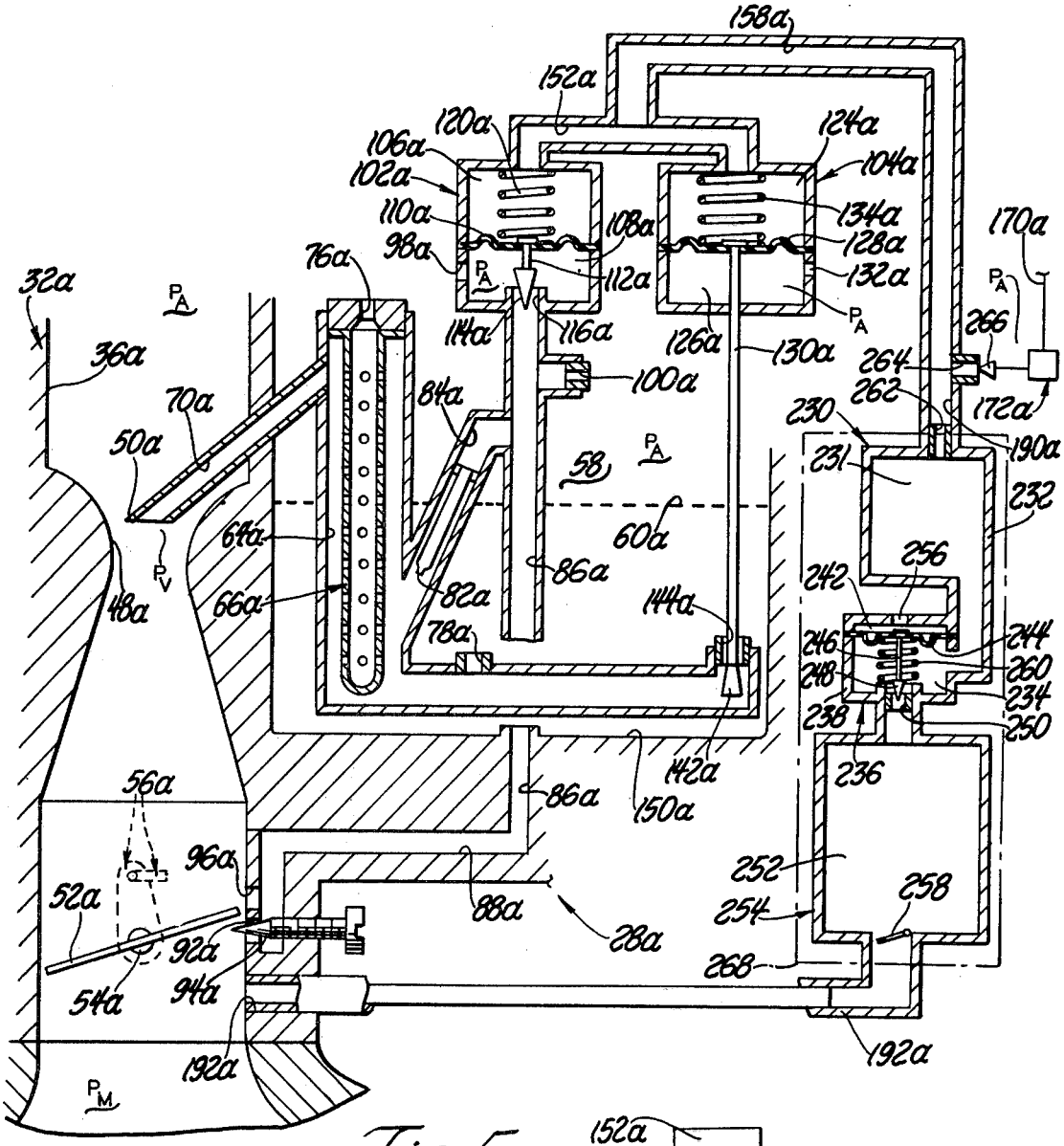
FIG. 5 is a generally cross-sectional view of another form of the invention.

FIG. 5, in somewhat simplified and diagrammatic form, illustrates a further form of the invention. All elements in FIG. 5 which are like or similar to those of FIGS. 1 and 2 are identified with like reference numbers, but having a suffix "a".

Aside from other features to be described, the structure of FIG. 5 illustrates the use of a main metering restriction **78*a* and an idle tubular metering restriction 82*a* situated generally downstream of restriction 78*a*, as is well known in the art. In retrospect, it will be apparent that restriction means 78 and 82 of FIG. 2 may be functionally arranged in the same manner as restrictions 78*a* and 82*a***.

Further, passage means **158*a* is illustrated as communicating generally between passage means 152*a* and suitable pressure accumulator means 230 which, as by related conduit means 232, in turn communicates with a chamber 234 of a pressure regulator assembly 236**.

The pressure regulator assembly 236 is illustrated as comprising housing means 238 having therein chamber means 234 and 242 effectively separated from each other as by movable pressure responsive wall or diaphragm means 244 to which is secured a stem portion 246 of a valve member 248 adapted to cooperate with a calibrated orifice pasage 250 serving to provide communication as between chamber 234 and chamber 252 of second pressure accumulator means 254. Suitable check valve means, such as, for example, a flapper valve as generally indicated at 258 is preferably provided in cooperation with chamber 252 of accumulator 254 to establish unidirectional flow, as through cooperating conduit means **192*a*** leading to a source of manifold vacuum, $P_m$.

As shown, chamber 234 of regulator 236 communicates with chamber 231 of accumulator 230 while chamber 242 is vented to atmosphere, as by passage or vent means 256. Suitable compression spring means 260 urges wall or diaphragm means 244 upwardly and simultaneously urges valve member 248 away from cooperating calibrated aperture or orifice means 250. Obviously, the smaller the effective flow area of orifice means 250 becomes, due to the increased closing thereof by valve member 248, the greater the pressure drop thereacross.

Preferably, calibrated restriction or passage means 262 is provided generally between passage **158*a* and chamber 231 to establish a desired rate of flow into chamber 231. Further, calibrated orifice or passage means 264 is provided generally upstream of calibrated passage 262 to communicate, generally, between the atmosphere and passage means 158***a*. Valving means, schematically illustrated at 172*a*, and comprising a variably positionable valve member 266, serves to variably but controllably determine the effective flow area of calibrated passage 264 in order to thereby vary the effective pressure, $V_c$, within passage 158*a* and chambers 106*a* and 124*a*. As previously explained with respect to valving means 172 of FIGS. 1 and 2, valving means 172*a* is actuated and controlled by the logic means 150 as via conductor means 170*a*. As previously stated, such valve means 172*a* may, in fact, comprise solenoid operated valving members.

As should be apparent, pressure regulator means, as at 236, may also be employed in the arrangement of FIG. 1 as by functionally placing such pressure regulator means in circuit with and between accumulator means 188 and control valve means 172. Generally, for all practical purposes, the combination and coaction of pressure accumulators 230, 254 and pressure regulator 236 provides a source 268 of generally constant subatmospheric pressure as far as conduit means 158*a* is concerned.

Figure 6:
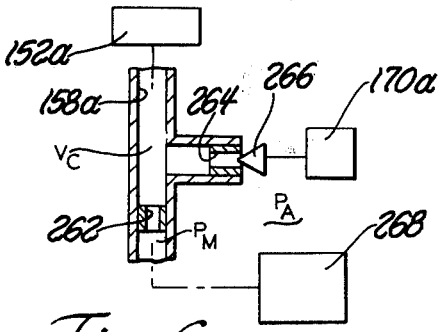
FIGS. 6 and 7 are each generally fragmentary and schematic illustrations of different arrangements for variably and controllably determining the magnitude of the actuating pressure differential employed in the invention.
Figure 7:
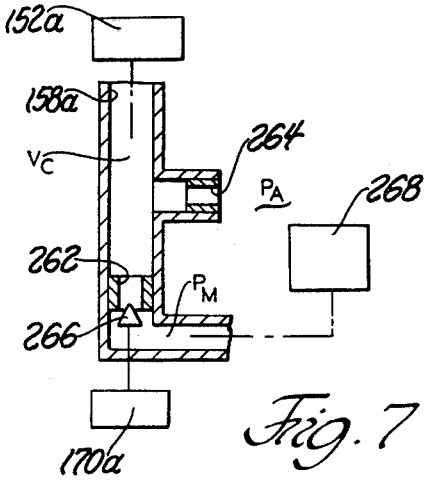

Various control valving means are contemplated. FIGS. 6 and 7 schematically illustrate two general arrangements of which FIG. 6 corresponds generally to the system of FIG. 5, wherein a valving member variably controls the degree of atmosheric air bleed permitted through suitable restriction means 264. FIG. 7 illustrates another general arrangement wherein the valving member 266 serves to variably control the degree of communication of the manifold or control vacuum with, for example, passage means 158*a*. Obviously, combinations of such systems as generally depicted by FIGS. 6 and 7 could also be employed.

Figure 8:
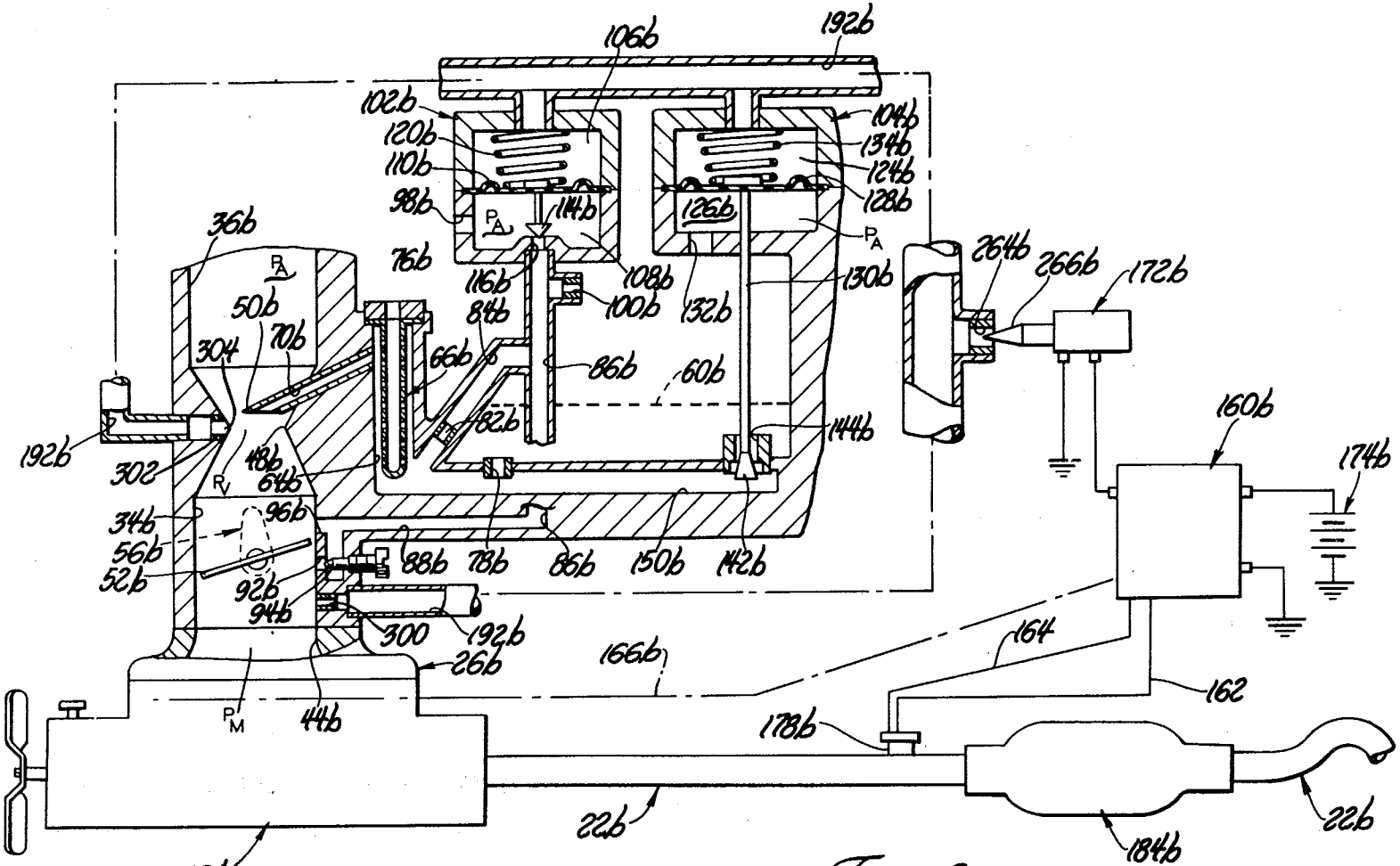
FIG. 8 is a generally cross-sectional view illustrating yet another aspect of the invention.

FIG. 8 illustrates yet another aspect of the invention. All elements in FIG. 8 which are like or similar to those of FIG. 1, 2 or 5 are identified with like reference numbers provided with a suffix "b".

Among other possible arrangements, the invention as shown in FIG. 8 contemplates the provision of suitable calibrated restriction passage means 300 in the passage means 192*b* leading to a source of engine or manifold vacuum as at a point in the carburetor structure generally downstream of the throttle valve 52*b*. Conduit or passage means 192*b* is shown having a sized or calibrated atmospheric bleed orifice 264*b* the effective area of which is variably controlled as by a valve 266*b* of a propoertional solenoid valve assembly 172*b* which, in turn, is controlled by the electrical logic and actuating means 106*b*. Branch conduit or passage means 192*b* leads to respective chambers 106*b* and 124*b* of motor means 102*b* and 104*b*. The other end of passage means 192*b* is operatively connected as to the induction passage 34*b* as at a point 304 to sense the venturi vacuum, $P_v$, and communicate such venturi vacuum to chambers 106*b* and 124*b*.

In the main, the use of venturi vacuum sensing means, as at 304, and manifold vacuum sensing means, as at 300, results in an overall available vacuum supply during all conditions of engine operation. That is, during relatively low engine speeds and engine loads the magnitude of the manifold vacuum, $P_m$, is relatively high while the magnitude of the venturi vacuum, $P_v$, is relatively low. However, during higher engine speeds and, for example, wide open throttle operation (WOT) the magnitude of the manifold vacuum becomes minimal while the magnitude of the venturi vacuum becomes relatively high. Therefore, it becomes possible, especially with selected values of flow restriction provided by restrictions 300 and 302, to employ sources of both manifold and venturi vacuum to provide the overall necessary pressure differential to achieve movement of valves 114*b* and 144*b* as dictated by the logic means 172*b*.

It is of course apparent, in view of the disclosure herein made, that the various vacuum passage means and chambers 106 (or 106*a* or 106*b*) and 124 (or 124*a* or 124*b*) may be formed as to comprise an overall carburetor structure. Also, it is contemplated that single motor means functioning equivalently to motor means 102 and 104 could be employed for the actuation of the related valve members 114 and 144.

Figure 9:
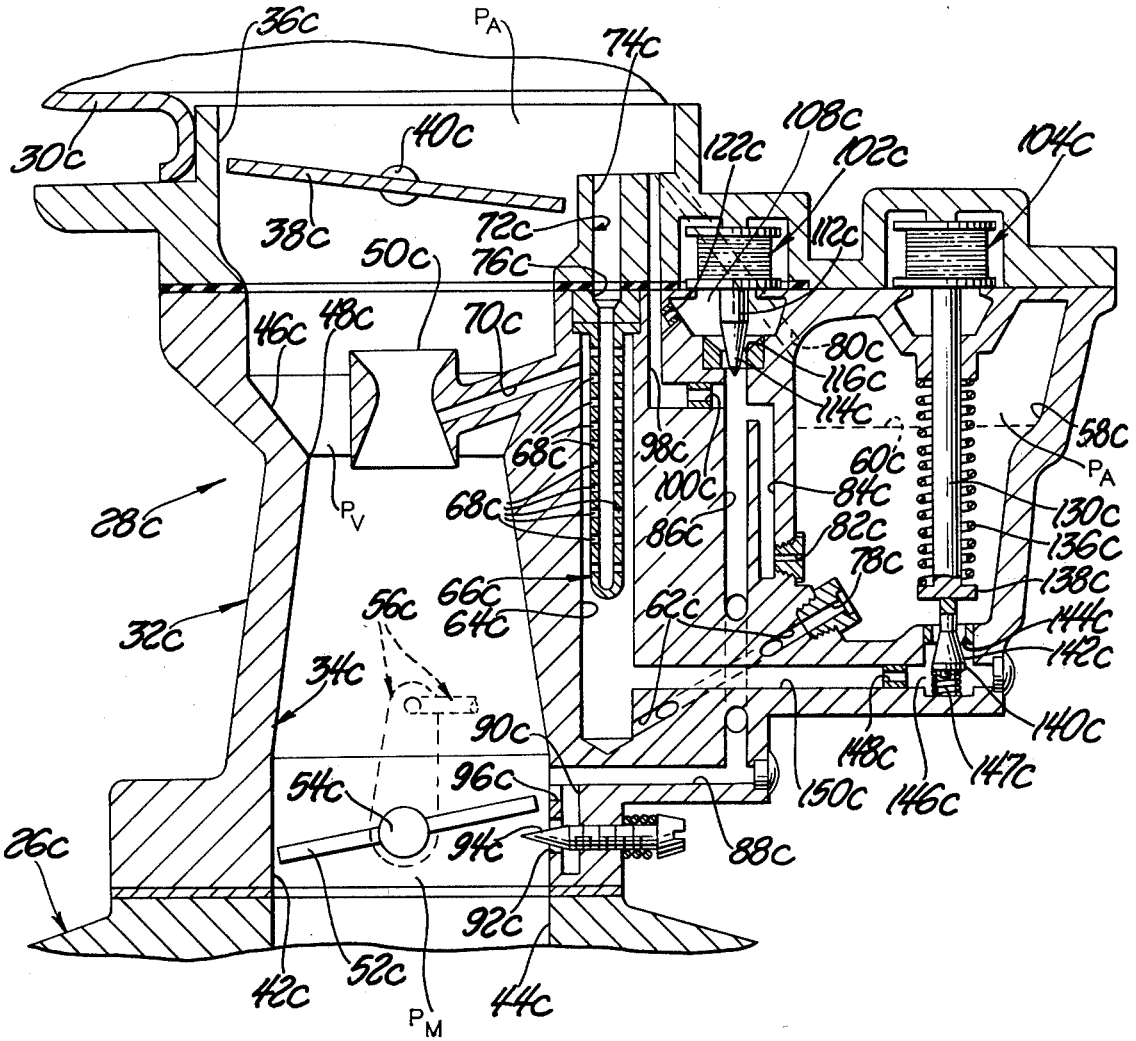
FIG. 9 is a view similar to FIG. 2 illustrating structure embodying teachings of the invention.

Further, as depicted in FIG. 9 (wherein elements which are like or functionally similar to those of FIG. 2 are identified with like reference numbers provided with a suffix "c"), it is also contemplated that instead of the pressure responsive motor means, such as 102 and 104 of FIG. 2, proportional type solenoid means 102*c* and 104*c* may be employed for directly controlling associated valve members 114*c* and 144*c* (equivalent to 114 and 114 of FIG. 2. In such event, there would be no need for creating a pressure differential as required for actuation of such valve members as 114 and 144 of FIG. 2. Instead, the logic means 160 would directly control the operation of the proportional solenoid 102*c* and 104*c*.

It should also be emphasized that the use of pulsating type control valve means 172 provides benefits which enable its use in even prior art structures in order to significantly improve their operation. That is, because of the pulsations created thereby in the pressure medium being applied to the pressure responsive motor means 102, 104, all inherent hysteresis is eliminated therefrom because of the slight but yet significant vibratory effect placed on such movable components of each of the motor means 102 and 104. This becomes extremely important where the overall system must have a very quick response time to even small increments of required change.

Although only one preferred embodiment and selected modifications of the invention have been disclosed and described, it is apparent that other embodiments and modifications of the invention are possible within the scope of the appended claims.

I claim:

1. A carburetor for a combustion engine, comprising carburetor body means, induction passage means formed in said body means, variably positionable throttle valve means for controlling the rate of motive fluid through said induction passage means and into said engine, fuel reservoir chamber means formed in said body means, idle fuel metering system means communicating generally between said fuel reservoir chamber means and said induction passage means, main fuel metering system means communicating generally between said fuel reservoir chamber means and said induction passage means, said idle fuel metering system means comprising first modulating valve means carried by said body means and effective to be variably positioned in order to thereby controllably alter the rate of metered idle fuel flow through said idle fuel metering system means to said induction passage means, said main fuel metering system means comprising second modulating valve means carried by said body means and effective to be variably positioned in order to thereby controllably alter the rate of metered main fuel flow through said main fuel metering system means to said induction passage means, first electrically energizable motor means carried by said body means and operatively connected to said first modulating valve means, said first electrically energizable motor means being effective to variably position said first modulating valve means in response to the electrical energization experienced by said first electrically energizable motor means, and second electrically energizable motor means carried by said body means and operatively connected to said second modulating valve means, said second electrically energizable motor means being effective to variably position said second modulating valve means in response to the electrical energization experienced by said second electrically energizable motor means.

2. A carburetor according to claim 1 wherein said first electrically energizable motor means comprises a solenoid assembly, wherein said first modulating valve means comprises a movable valve member, and wherein said movable valve member is operatively connected to said solenoid assembly.

3. A carburetor according to claim 1 wherein said second electrically energizable motor means comprises a solenoid assembly, wherein said second modulating valve means comprises a movable valve member, and wherein said movable valve member is operatively connected to said solenoid assembly.

4. A carburetor according to claim 3 and further comprising spring means operatively connected to said movable valve member.

5. A carburetor according to claim 4 wherein said spring means normally urges said movable valve member in a direction which results in an increase in the rate of metered main fuel through said main fuel metering system means to said induction passage means.

6. A carburetor according to claim 1 wherein said first electrically energizable motor means comprises a first solenoid assembly, wherein said first modulating valve means comprises a first movable valve member, wherein said first movable valve member is operatively connected to said first solenoid assembly, wherein said second motor means comprises a second solenoid assembly, wherein said second modulating valve means comprises a second movable valve member, and wherein said second movable valve member is operatively connected to said second solenoid assembly.

7. A carburetor according to claim 1 wherein said first modulating valve means comprises atmospheric air bleed means, said air bleed means comprising air bleed orifice means and movable valve means, wherein said first motor means comprises a solenoid assembly, wherein said movable valve means is operatively connected to said solenoid assembly as to be moved thereby and in accordance therewith, wherein said movable valve means when moved by said solenoid assembly in a first direction being effective to increase the effective flow area of said air bleed orifice means, and said movable valve means when moved in a second direction opposite to said first direction being effective to decrease the effective flow area of said air bleed orifice means.

8. A carburetor according to claim 7 wherein when said movable valve means is moved in said first direction the rate of metered flow of idle fuel flow through said idle fuel metering system means to said induction passage means is decreased.

9. A carburetor according to claim 7 wherein said air bleed orifice means comprises first and second air bleed orifices, and wherein said movable valve member cooperates with one of said first and second air bleed orifices in varying the effective flow area thereof.

10. A carburetor according to claim 9 wherein said first and second air bleed orifices are in parallel circuit relationships with respect to each other.

11. A carburetor according to claim 10 and further comprising calibrated flow restriction means in fluid circuit series relationship with said one of said first and second air bleed orifices, and wherein said calibrated flow restriction means is in parallel circuit relationship with the other of said first and second air bleed orifices.

12. A carburetor according to claim 1 wherein said second modulating valve means comprises orifice means, and a valve member cooperating with said orifice means to variably define therebetween an effective fuel metering area.

13. A carburetor according to claim 1 wherein said second modulating valve means comprises first orifice means and a valve member cooperating with said first orifice means to variably define therebetween an effective fuel metering area, wherein said main fuel metering system means further comprises calibrated second orifice means, and wherein said first and second orifice means are in parallel fluid circuit relationship to each other as to have each communicate with said fuel reservoir chamber means.

14. A carburetor according to claim 1 wherein said second modulating valve means comprises first orifice means and a valve member cooperating with said first orifice means to variably define therebetween an effective fuel metering area, wherein said main fuel metering system means further comprises calibrated second orifice means, wherein said first and second orifice means are in parallel fluid circuit relationship to each other, wherein said main fuel metering system means further comprises calibrated third orifice means, and wherein said third orifice means is in series fluid circuit relationship with said first orifice means and in parallel circuit relationship with said second orifice means.

15. A carburetor according to claim 1 wherein said second modulating valve means comprises orifice means and a valve member cooperating with said orifice means to variably define therebetween an effective fuel metering area, wherein said second motor means comprises solenoid assembly means, wherein said valve member is operatively connected to said solenoid assembly means for movement therewith, and further comprising first spring means operatively engaging said valve member, and second spring means operatively engaging said valve member, said second spring means being effective to urge said valve member in a direction resulting in a decrease in said effective fuel metering area.

16. A carburetor for a combustion engine, comprising carburetor body means, induction passage means formed in said body means, variably positionable throttle valve means for controlling the rate of motive fluid through said induction passage means and into said engine, fuel reservoir chamber means formed in said body means, idle fuel metering system means communicating generally between said fuel reservoir chamber means and said induction passage means, main fuel metering system means communicating generally between said fuel reservoir chamber means and said induction passage means for supplying rates of metered main fuel flow throughout the entire range of required rate of metered main fuel flow, said main fuel metering system means comprising modulating valve means carried by said body means and effective to be variably positioned in order to thereby controllably alter the rate of metered main fuel flow through said main fuel metering system means to said induction passage means, and electrically energizable motor means carried by said body means and operatively connected to said modulating valve means, said electrically energizable motor means being continuously effective throughout said entire range of required rates of metered main fuel flow to continuously variably position said modulating valve means in response to the electrical energization experienced by said electrically energizable motor means, said modulating valve means comprising first orifice means and a valve member cooperating with said first orifice means to variably define therebetween an effective fuel metering area, said main fuel metering system means further comprising calibrated second orifice means, said first and second orifice means being in parallel fluid circuit relationship to each other, said main fuel metering system means further comprising calibrated third orifice means, and said third orifice means being in series fluid circuit relationship with said first orifice means and in parallel circuit relationship with said second orifice means.

17. A carburetor for a combustion engine, comprising carburetor body means, induction passage means formed in said body means, variably positionable throttle valve means for controlling the rate of motive fluid through said induction passage means and into said engine, fuel reservoir chamber means formed in said body means, main fuel metering system means communicating generally between said fuel reservoir chamber means and said induction passage means for supplying rates of metered main fuel flow throughout the entire range of required rate of metered main fuel flow, said main fuel metering system means comprising modulating valve means carried by said body means and effective to be variably positioned in order to thereby controllably alter the rate of metered main fuel flow through said main fuel metering system means to said induction passage means, and electrically energizable motor means carried by said body means and operatively connected to said modulating valve means, said electrically energizable motor means being continuously effective throughout said entire range of required rates of metered main fuel flow to continuously variably position said modulating valve means in response to the electrical energization experienced by said electrically energizable motor means, said modulating valve means comprising first orifice means and a valve member cooperating with said first orifice means to variably define therebetween an effective fuel metering area, said main fuel metering system means further comprising calibrated second orifice means, said first and second orifice means being in parallel fluid circuit relationship to each other, said main fuel metering system means further comprising calibrated third orifice means, and said third orifice means being in series fluid circuit relationship with said first orifice means and in parallel circuit relationship with said second orifice means.

18. A carburetor for a combustion engine, comprising carburetor body means, induction passage means formed in said body means, variably positionable throttle valve means for controlling the rate of motive fluid through said induction passage means and into said engine, fuel reservoir chamber means formed in said body means, main fuel metering system means communicating generally between said fuel reservoir chamber means and said induction passage means, additional fuel metering system means communicating generally between said fuel reservoir chamber means and said induction passage means, said main fuel metering system means comprising first modulating valve means carried by said body means and effective to be variably positioned in order to thereby controllably alter the rate of metered main fuel flow through said main fuel metering system means to said induction passage means, said additional fuel metering system means comprising second modulating valve means carried by said body means and effective to be variably positioned in order to thereby controllably alter the rate of metered additional fuel flow through said additional fuel metering system means to said induction passage means, first electrically energizable motor means carried by said body means and operatively connected to said first modulating valve means, said first electrically energizable motor means being effective to variably position said first modulating valve means in response to the electrical energization experienced by said first electrically energizable motor means, and second electrically energizable motor means carried by said body means and operatively connected to said second modulating valve means, said second electrically energizable motor means being effective to variably position said second modulating valve means in response to the electrical energization experienced by said second electrically energizable motor means.

19. A carburetor according to claim 18 wherein said first electrically energizable motor means comprises a solenoid assembly, wherein said first modulating valve means comprises a movable valve member, and wherein said movable valve member is operatively connected to said solenoid assembly.

20. A carburetor according to claim 18 wherein said second electrically energizable motor means comprises a solenoid assembly, wherein said second modulating valve means comprises a movable valve member, and wherein said movable valve member is operatively connected to said solenoid assembly.

21. A carburetor according to claim 19 and further comprising spring means operatively connected to said movable valve member.

22. A carburetor according to claim 21 wherein said spring means normally urges said movable valve member in a direction which results in an increase in the rate of metered main fuel through said main fuel metering system means to said induction passage means.

23. A carburetor according to claim 18 wherein said first fluid motor means comprises a first solenoid assembly, wherein said first modulating valve means comprises a first movable valve member, wherein said first movable valve member is operatively connected to said first solenoid assembly, wherein said second motor means comprises a second solenoid assembly, wherein said second modulating valve means comprises a second movable valve member, and wherein said second movable valve member is operatively connected to said second solenoid assembly.

24. A carburetor according to claim 18 wherein said second modulating valve means comprises atmospheric air bleed means, said air bleed means comprising air bleed orifice means and movable valve means, wherein said second motor means comprises a solenoid assembly, wherein said movable valve means is operatively connected to said solenoid assembly as to be moved thereby and in accordance therewith, wherein said movable valve means when moved by said solenoid assembly in a first direction being effective to increase the effective flow area of said air bleed orifice means, and said movable valve means when moved in a second direction opposite to said first direction being effective to decrease the effective flow area of said air bleed orifice means.

25. A carburetor according to claim 24 wherein when said movable valve means is moved in said first direction the rate of metered flow of said additional fuel flow through said additional fuel metering system means to said induction passage means is decreased.

26. A carburetor according to claim 24 wherein said air bleed orifice means comprises first and second air bleed orifices, and wherein said movable valve member cooperates with one of said first and second air bleed orifices in varying the effective flow area thereof.

27. A carburetor according to claim 26 wherein said first and second air bleed orifices are in parallel circuit relationships with respect to each other.

28. A carburetor according to claim 27 and further comprising calibrated flow restriction means in fluid circuit series relationship with said one of said first and second air bleed orifices, and wherein said calibrated flow restriction means is in parallel circuit relationship with the other of said first and second air bleed orifices.

29. A carburetor according to claim 18 wherein said first modulating valve means comprises orifice means, and a valve member cooperating with said orifice means to variably define therebetween an effective fuel metering area.

30. A carburetor according to claim 18 wherein said first modulating valve means comprises first orifice means and a valve member cooperating with said first orifice means to variably define therebetween an effective fuel metering area, wherein said main fuel metering system means further comprises calibrated second orifice means, and wherein said first and second orifice means are in parallel fluid circuit relationship to each other as to have each communicate with said fuel reservoir chamber means.

31. A carburetor according to claim 18 wherein said first modulating valve means comprises first orifice means and a valve member cooperating with said first orifice means to variably define therebetween an effective fuel metering area, wherein said main fuel metering system means further comprises calibrated second orifice means, wherein said first and second orifice means are in parallel fluid circuit relationship to each other, wherein said main fuel metering system means further comprises calibrated third orifice means, and wherein said third orifice means is in series fluid circuit relationship with said first orifice means and in parallel circuit relationship with said second orifice means.

32. A carburetor according to claim 18 wherein said first modulating valve means comprises orifice means and a valve member cooperating with said orifice means to variably define therebetween an effective fuel metering area, wherein said first motor means comprises solenoid assembly means, wherein said valve member is operatively connected to said solenoid assembly means for movement therewith, and further comprising first spring means operatively engaging said valve member, and second spring means operatively engaging said valve member, said second spring means being effective to urge said valve member in a direction resulting in a decrease in said effective fuel metering area.

* * * * *